US006491386B2

(12) United States Patent
Hierro et al.

(10) Patent No.: US 6,491,386 B2
(45) Date of Patent: Dec. 10, 2002

(54) PRINT MEDIA FLATTENING METHOD AND APPARATUS

(75) Inventors: Lluis Hierro; Macia Sole; Xavier Alonso, all of Barcelona (ES)

(73) Assignee: Hewlett Packard Company, Fort Collins, CO (US)

( * ) Notice: Subject to any disclaimer, the term of this patent is extended or adjusted under 35 U.S.C. 154(b) by 79 days.

(21) Appl. No.: 09/773,125

(22) Filed: Jan. 31, 2001

(65) Prior Publication Data

US 2002/0101492 A1 Aug. 1, 2002

(51) Int. Cl.[7] ..... B41J 29/38; B41J 2/01
(52) U.S. Cl. ..... 347/76; 347/104
(58) Field of Search ..... 347/16, 104; 400/613.3; 271/275, 266, 902; 226/123

(56) References Cited

U.S. PATENT DOCUMENTS 4,683,481 A 7/1987 Johnson
5,278,584 A 1/1994 Keefe et al.
5,465,110 A * 11/1995 Carlotta et al. ..... 347/104
5,874,979 A * 2/1999 Ohyama ..... 347/104

* cited by examiner

*Primary Examiner*—John Barlow
*Assistant Examiner*—Michael S Brooke
(74) *Attorney, Agent, or Firm*—Ashen & Lippman

(57) ABSTRACT

A method of flattening print media in an ink jet apparatus, said apparatus comprising a media feed path, a media drive roller and one or more pinch rollers, said one or more pinch rollers being arranged to rotatably cooperate with said drive roller so as to grip said media therebetween, said drive roller having a rotational axis extending substantially transverse to said feed path and being arranged to rotate in first and second directions to respectively feed said media in first and second feed directions; said method comprising the steps of: feeding said media a first distance in said first feed direction; and then, feeding said media a second distance in said second feed direction, thereby causing said media to flatten in a direction substantially transverse to said feed path.

20 Claims, 4 Drawing Sheets

FIG. 4
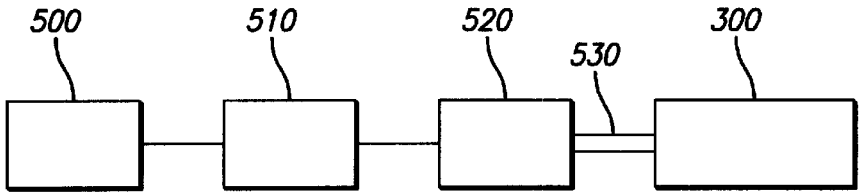
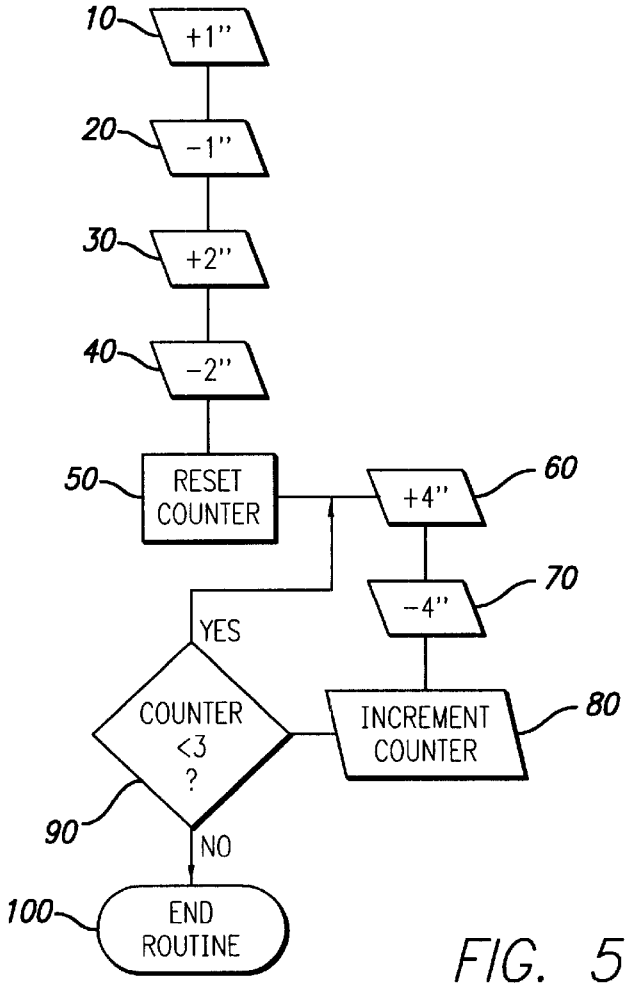
FIG. 5

PRINT MEDIA FLATTENING METHOD AND APPARATUS

TECHNICAL FIELD OF THE INVENTION

The present invention relates generally to inkjet apparatus, including inkjet printing mechanisms, and more particularly to improved mechanism and method for avoiding print head crashes in such apparatus.

BACKGROUND OF THE INVENTION

Inkjet printing mechanisms may be used in a variety of different inkjet apparatus, such as plotters, facsimile machines, copiers, and inkjet printers collectively referred to in the following as printers, to print images using a colorant, referred to generally herein as "ink". These inkjet printing mechanisms use inkjet cartridges, often called "pens" or "print heads" to shoot drops of ink onto print media, which can be used in the form of cut sheets or rolls of print media, which may include paper, vinyl, films, canvas or the like, in a variety of different dimensions.

Some inkjet print mechanisms carry an ink cartridge with an entire supply of ink back and forth across the sheet. Other inkjet print mechanisms, known as "off-axis" systems, propel only a small ink supply with the print head carriage across the print zone, and store the main ink supply in a stationary reservoir, which is located "off-axis" from the path of print head travel. Typically, a flexible conduit or tubing is used to convey the ink from the off-axis main reservoir to the print head cartridge. In multi-color cartridges, several print heads and reservoirs are combined into a single unit, with each reservoir/print head combination for a given color also being referred to herein as a "pen."

Each pen has a nozzle plate that includes very small nozzles through which the ink drops are fired. The particular ink ejection mechanism within the print head may take on a variety of different forms known to those skilled in the art, such as those using piezo-electric or thermal print head technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

By selectively energizing the resistors as the print head moves across the sheet, the ink is expelled in a pattern on the print media to form a desired image (e.g., picture, chart or text). The nozzles are typically arranged in one or more linear arrays. If more than one, the two linear arrays are located generally side-by-side on the print head, parallel to one another, and substantially perpendicular to the scanning direction. Thus, the length of the nozzle arrays defines a print swath or band. That is, if all the nozzles of one array were continually fired as the print head made one complete traverse through the print zone, a band or swath of ink would appear on the sheet. The height of this band is known as the "swath height" of the pen, the maximum pattern of ink that can be laid down in a single pass.

For placing further print swaths on the print media, a print media feed mechanism is employed to advance or index the medium in the print zone in a second direction, called the media direction, which is usually substantially perpendicular to scanning direction of the print head.

Thus, to print an image, the print head is scanned back and forth across a print zone at a very close distance above the sheet, with the pen shooting drops of ink as it moves. On one hand, for instance, the distance between the printhead and the paper must be as small as possible, for example less than 1.7 mm, in order to obtain an accurate positioning of the ink dots projected from the printhead and to avoid spraying artefacts.

However, when a lot of ink is placed on some print media (especially on low cost paper based media) the print media may be subject to a phenomenon known as "cockle". In existing printers, cockle results from the print media swelling and expanding as it absorbs water contained in the ink, whilst the print media is simultaneously constrained against lateral expansion due to being gripped at given locations along the scan axis (i.e. along the axis of movement of the print head), between the pinch wheels and the main drive roller.

This results in the formation of undulations or wrinkles in the plane of the print media. As a consequence, the distance between the print media and the print head decreases at some localized points. This phenomenon is especially noticeable when printing area fills of more than 200%. By this it is meant that in a given area of print media, the amount of ink deposited during the printing operation is two or more times the quantity of ink that is required to cover that area.

If the degree of cockle is particularly severe, a "bubble" in the media may form. If the height of the media bubble is sufficient, the plot may be damaged as ink on the plot is smeared by the print head. Indeed, in more severe cases, a media crash may occur as the print head impacts against the print media itself. A media crash may seriously affect the subsequent print quality or throughput of the printer due to damaging the operation of individual nozzles of the pen. In some cases a media crash may necessitate the replacement of the pen.

This problem is of particular concern where a printer prints a series of plots from a roll of print media, when unsupervised by a human operator, as is often the case in commercial printing operations. This is because the print media expands in a cumulative manner. As a consequence, the chance of a media bubble being generated increases with each successive plot until the pinch rollers are released allowing the media to "relax" and so to flatten once again against the platen of the printer. Thus, even if a printer may print a single high density plot without risk of a media bubble forming, it may be at risk of a print media crash if it is left unattended to print a series of plots form a role of print media. As the skilled reader will appreciate, if the media bubble should grow sufficiently, a media crash may then arise.

Furthermore, even if the occurrence of a media bubble does not result in a print media crash, a further problem may arise. Once formed, during a printing operation a media bubble will generally expand in the opposite direction to that in which the print media is fed at approximately the rate at which the print media advances. Generally, this will continue for as long as the printer continues to print on a continuous sheet or role of print media. In such a situation, all plots printed on the same sheet or roll of print media, subsequent to the one in which the media bubble developed, will additionally be damaged. Thus, the amount of damage that may be caused, in terms of lost output and wasted supplies, may be considerable if a printer which is printing multiple plots from a roll is left unattended.

SUMMARY OF THE INVENTION

In view of the foregoing, it is an object of the present invention to provide an improved inkjet apparatus and an improved method for operating an inkjet apparatus.

A further object of the invention is to provide an inkjet apparatus and method for operating an inkjet apparatus for reducing the likelihood of a print head crashes, particularly when printing on roll fed print media and where the inkjet apparatus is not supervised by a human operator.

Still another object of the present invention is to provide an inkjet apparatus and method for operating an inkjet apparatus for reducing the damage to plots caused by the occurrence of media bubbles, particularly when using roll fed print media and where the inkjet apparatus is not supervised by a human operator.

To achieve these objects, the present invention provides for an inkjet apparatus and method for allowing print media, which has cockled, to relax and so to lie flat on the platen of the printer, without requiring the pinch rollers to be released from engagement with the main drive roller of the printer. According to the present invention there is provided a method of flattening print media in an ink jet apparatus, said apparatus comprising a media feed path, a media drive roller and one or more pinch rollers, said one or more pinch rollers being arranged to rotatably cooperate with said drive roller so as to grip said media therebetween, said drive roller having a rotational axis extending substantially transverse to said feed path and being arranged to rotate in first and second directions to respectively feed said media in first and second feed directions; said method comprising the steps of: feeding said media a first distance in said first feed direction; and then, feeding said media a second distance in said second feed direction, thereby causing said media to flatten in a direction substantially transverse to said feed path.

By implementing the media flattening method of the present invention in this manner several advantages are realized. Firstly, by periodically implementing the method of the invention, the print media will be left flat, without media bubbles. This means further ink may be deposited on the print media, without the increasing the risk of a media bubble forming, as has been described above. Because the method of the present invention may be implemented without the need to raise the pinch wheels, it may be implemented in an automated manner, without the need for an operator to be present. Consequently, a printer may be left unattended to print a series of images on a roll of print media, without the risk of a series of plots being damaged by the formation of a single media bubble. This feature of the present invention makes it particularly suitable for applications in which it is especially important to avoid wasting printer supplies and where unsupervised operation is desirable; for example commercial print operations.

Using the process of the present invention, the media may be left ready to be printed on again at the end of the process at the exact point where the previous print finished. Thus, it may be ensured that no print media is wasted, which is if course an important consideration in a commercial print operation.

The use of the present invention also allows printer operators to conserve costs by using cheaper paper, that is more normally susceptible to cockling and media bubbles in unsupervised printing operations.

BRIEF DESCRIPTION OF THE DRAWINGS

The invention will be described with reference to the accompanying drawings, wherein:

FIG. 4 is a block diagram illustrating the process by which the media feeds of an embodiment of the invention are realized;

FIG. 5 is a flow chart which illustrates the print media handling process of an embodiment of the present invention.

DETAILED DESCRIPTION OF THE PREFERRED EMBODIMENT(S)

Figure 1:
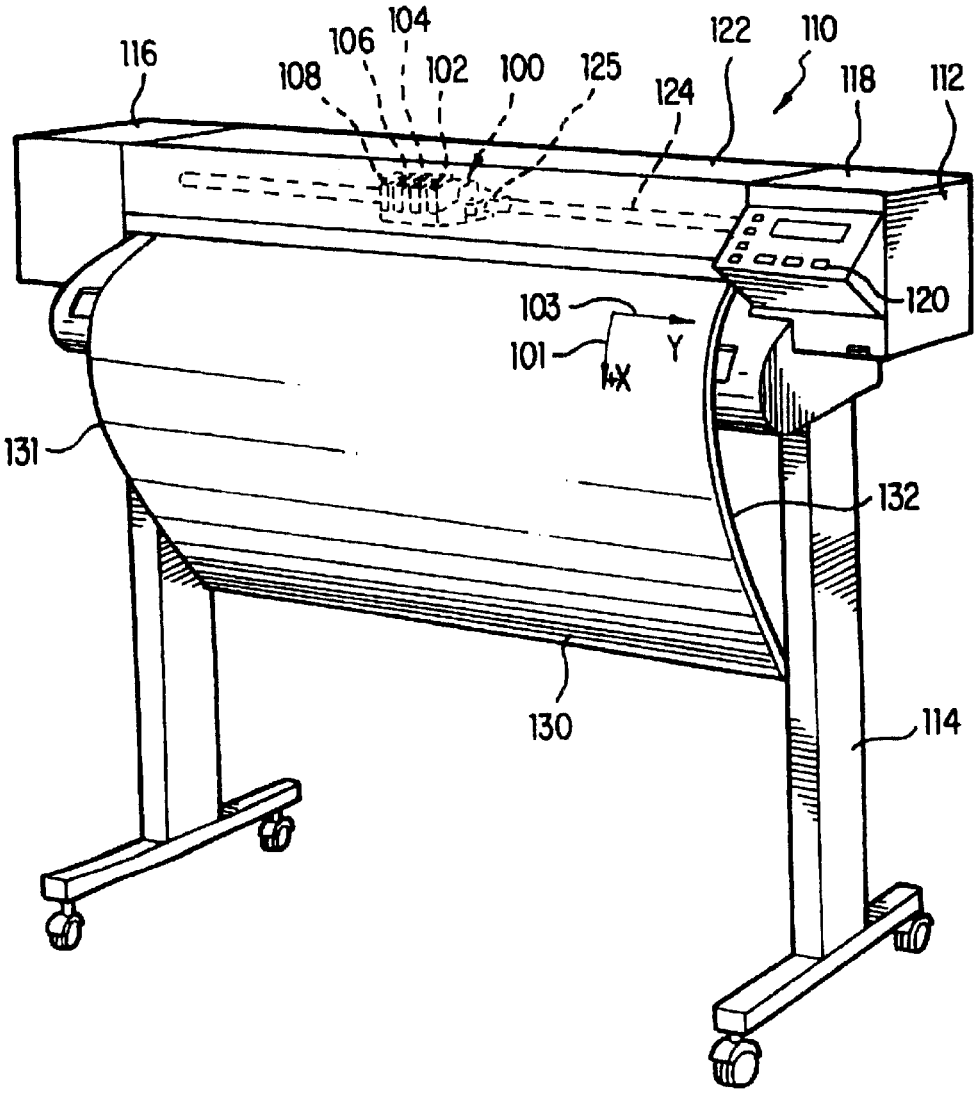
FIG. 1 is a perspective view of an inkjet printer arranged to implement an embodiment of the present invention.

Referring to FIG. 1, a printer 110 includes a housing 112 mounted on a stand 114. The housing has left and right drive mechanism enclosures 116 and 118. A control panel 120 is mounted on the right enclosure 118. A carriage assembly 100 illustrated in phantom line under a cover 122, is adapted for reciprocal motion along a carriage bar 124, also shown in phantom line. The carriage assembly 100 comprises four inkjet print heads 102, 104, 106, 108 that store ink of different colors, e.g. black, magenta, cyan and yellow ink respectively, and an optical sensor 125. The inkjet print heads 102, 104, 106, 108, are held rigidly in the movable carriage 100 so that the print head nozzles scan above the surface of the medium 130 in a controlled manner with the carriage assembly 100.

The position of the carriage assembly 100 in the horizontal, or carriage scan axis (Y-axis), direction is determined by a carriage positioning mechanism (not shown) with respect to an encoder strip (not shown).

As the carriage assembly 100 translates relative to the medium 130 along the X and Y axes, selected nozzles of the print heads 102, 104, 106, 108 are activated and dots of ink are deposited in the desired pattern on the print media 130, having two edges 131, and 132. The ink dots deposited on the print media are mixed as and where required in order to obtain the desired color.

The print media 130, such as paper, which in this embodiment is in the form of a roll (not shown) mounted behind the body of the printer 110, is positioned along a vertical or media axis by a media axis mechanism (not shown). As used herein, the media axis is called the X-axis denoted as 101, and the scan axis is called the Y-axis denoted as 103.

Figure 2:
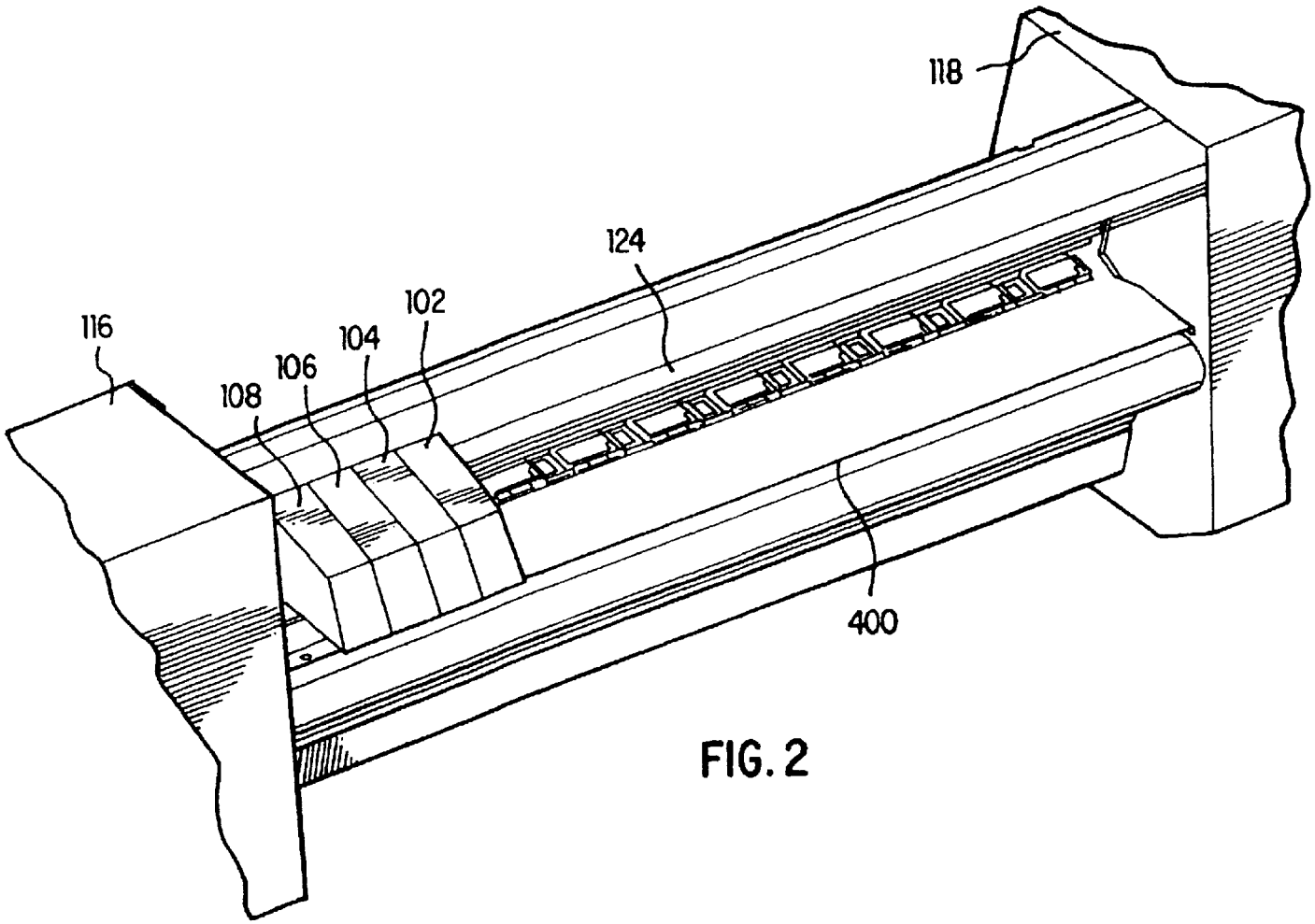
FIG. 2 is a more detailed diagram of a portion of the printer of FIG. 1.

Referring now to FIG. 2, a flat stationary support platen 400 is located between the left and right drive mechanism enclosures 116 and 118. The width of the platen 400 along the Y-axis, or scan axis, is at least equal to the maximum allowable width of the print media. In this example it should allow the employment of media having width up to 36 inches, i.e. 914 mm. The platen 400 is arranged to support the print media such that it is substantially flat when lying underneath the carriage assembly, as the carriage assembly translates along the carriage bar during a printing operation.

Figure 3:
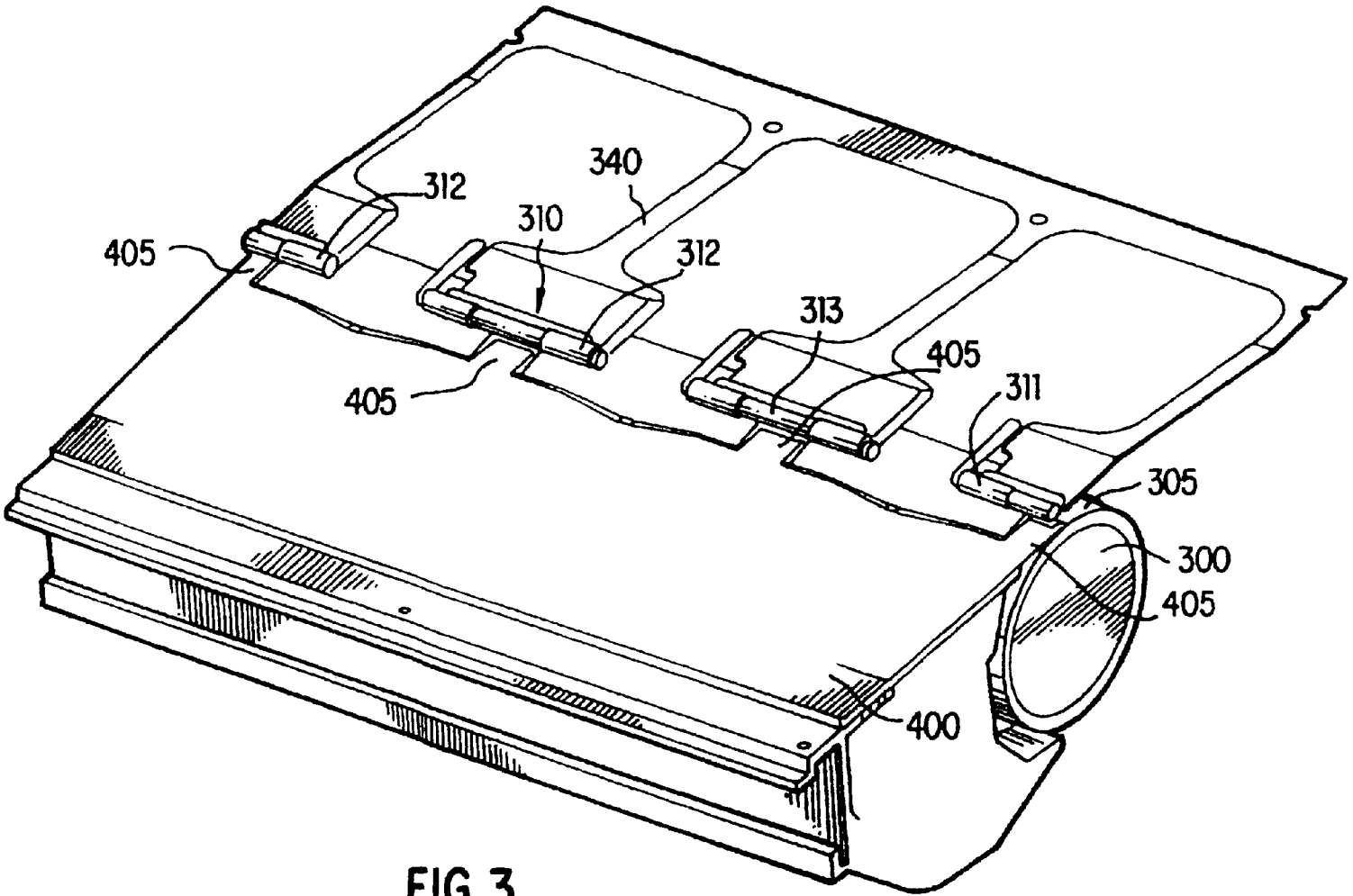
FIG. 3 depicts a more detailed view of the components arranged to drive the print media in the printer of FIG. 1.

The platen 400 is shown in more detail in FIG. 3. As is shown in the figure, the platen 400 is provided with a plurality of protrusions 405 extending towards the rear of the printer 110. The protrusions 405 are located in corresponding circumferential recesses 305, in the otherwise conventional surface of the main roller 300. This arrangement allows the medium 130 to reliably move from the main roller 300 to the platen 400 and vice versa as it is fed during a media feed or printing operation. The skilled reader will appreciate that a gap or a step between the main roller 300 and the platen 400 may allow an edge of the print media to engage the edge or underside of the platen, instead of the upper surface of the platen, causing a paper jam.

In this example 12 pinch wheels 310, also known as pinch rollers, are arranged, spaced along scan axis 103 of the printer, above the main roller 300. Each of the pinch wheels 310 is formed from two cylindrical end segments 311 and 312, which preferably have substantially the same length. The end segments 311, 312 are joined by a third central cylindrical segment 313 having a longer length and a smaller diameter than the two end segments, preferably of about 5 mm. The end segments 311 and 312 are arranged to contact with the print medium, whilst the central segments 313, due to its reduced diameter, is arranged not touch with the print media.

During a printing operation, the print media passes between the main drive roller 300 and the pinch wheels 310. The main driving roller 300 is driven to rotate by a motor 520 (shown in FIG. 4) under the control of a printer control unit 500 (shown in FIG. 4) to periodically index or convey the print medium across the surface of the platen 400 in a stepwise manner in the print media feed direction (X axis shown in FIG. 1). As will be known to the skilled reader, the main drive roller 300 may be controlled by the printer control unit 500 to rotate in either direction, thus allowing the print medium to be fed through the print zone of the printer in either a positive or a negative direction.

A number of springs 340 are arranged to generate a contact force between each pinch wheel 310 and the main roller 300. In the present embodiment, this force is preferably between 3.33N and 5N, more preferably 4.15N. The distribution and force of the pinch wheels 310 help to ensure that the print medium 130 is driven traight during printing, with negligible lateral slippage. The main roller 300 is preferably made of a relatively soft material such as rubber, to increase the friction with the print medium, while the pinch wheels are made of a harder material such as plastic.

In operation, the printer carries out the process of printing a plot in a standard manner as is well known to the skilled reader. Any suitable print mode may be used to create the plot. For example; the desired each swath may be printed in a single pass of the carriage; the nozzles of each print head eject corresponding ink drops on the paper and then the paper is displaced a length corresponding to the dimension of the print zone (swath height). In higher quality printing the print heads perform several passes, for example eight, before the paper advances the full length of the print zone (swath height): the paper is displaced after each pass a length equal to only ⅛th of the dimension of the print zone (swath height), and the print heads deposit on the paper in each pass only ⅛th of the total amount of ink. Additionally, each alternate swath may be printed when the carriage is moving in a direction to that when the previous swath was printed (bidirectional printing); or, for higher quality printing each swath may be printed whilst the carriage is moving in the same direction (unidirectional printing).

Referring to FIGS. 4 and 5, the media feed operations of the present embodiment will now be described.

In the present embodiment, sequence of media feeds is implemented after the completion of every plot. However, the skilled person will appreciate that such operations may be carried out at different intervals, as is discussed below. The sequence of print media feeds is controlled by the printer control unit 500 running a print media feed algorithm stored in software, firmware or hardware associated with the printer apparatus in a conventional manner, as will be familiar to the skilled reader.

Thus, when a plot is completed, the printer control unit 500 implements a predetermined sequence of media feed operations, which is illustrated in FIG. 5. At each output of the media feed routine, the printer control unit 500 outputs media feed control signals to control the media feed operations, in the manner shown in FIG. 4. The printer control unit 500 outputs media feed control signals to the motor control circuitry 510. The motor control circuitry 510 activates the motor 520 to rotate the main drive roller 300, via through drive shaft 530, the desired amount in the desired direction.

At step 10 of the media feed routine the printer control unit 500 outputs media feed control signals causing the print media 130 to be fed in a forward direction (i.e. the normal print feed direction, which is designated by the positive "X" axis in FIG. 1) by approximately 1 inch (25 mm). At step 20, the printer control unit 500 outputs media feed control signals causing the print media 130 to be fed in a backward direction (i.e. the reverse feed direction or negative "X" axis direction of FIG. 1) by approximately 1 inch (25 mm). At step 30, the printer control unit 500 outputs media feed control signals causing the print media 130 to be fed in a forward direction by approximately 2 inches (50 mm). At step 40, the printer control unit 500 outputs media feed control signals causing the print media 130 to be fed in a backward direction by approximately 2 inches (50mm). At step 50, the printer control unit 500 resets an internal (software) counter to zero. At step 60, the printer control unit 500 outputs media feed control signals causing the print media 130 to be fed in a forward direction by approximately 4 inches (50 mm). At step 70, the printer control unit 500 outputs media feed control signals causing the print media 130 to be fed in a backward direction by approximately 4 inches (50 mm). At step 80, the printer control unit 500 increments the internal counter by one. At step 90 the printer control unit 500 determines whether the internal counter is less than three. If the counter is less than three, steps 60, 70 and 80 are repeated; thus causing the print media to be fed in a positive direction by approximately 4 inches (50 mm), then causing the print media to be fed in a negative direction by approximately 4 inches (50 mm) and causing the counter to be incremented by one. Thus, once the print media feed steps of step 60 and 70 have been implemented three times, the counter at step 80 will be incremented to three. Thus, at step 90, the counter will equal three and so the routine will be stopped at step 100.

The skilled reader will appreciate that in this embodiment, the media feeds are carried out on print media which has not yet been printed on, in order to avoid smudging or damaging an image which has been recently printed. This ensured since each media feed in a reverse direction is preceded by one of at least equal length in the forward direction.

This sequence of media feeds has the effect of allowing media bubbles in the print media 130 to slip progressively along the scan axis of the printer, between the pinch wheels 310 and the main drive roller 300, from the center of the print media towards its edges 131,132. This process occurs whilst the pinch rollers 310 are still engaging the main drive roller 300; i.e. without the pinch rollers having been released. This means that no operator involvement is required to release the pinch rollers 310. Thus, the whole procedure may be implemented in an automatic, unsupervised manner.

The result of the slippage of the print media 130 is that the print media 130 becomes once again spread evenly, along the entire width (Y-axis) of the print media, over the surface of the platen 400 and the main drive roller 300. Thus, more ink may be deposited on the print media as a new plot is undertaken without an incurring an increased risk of a media bubble forming during the subsequent plot.

As the skilled read will appreciate, the sequence of media feeds of the preferred embodiment finishes leaving the print media in the same position with respect to the printer mechanism as it was when the last plot was completed. Thus, at the completion of the sequence of media feeds, the printer and the print media are ready to commence a new plot on the same roll of print media, immediately adjacent to the end of the previous plot. Thus, no print media need be wasted using the method of the present embodiment.

It has been established through practical investigation that is preferable that the initial media feed steps, corresponding to steps 10 to 40 of FIG. 5, are of short distances only. This is because media feed steps of longer distances have been found to have the effect of encouraging media bubbles that have developed to continue growing in the direction opposite to the feed direction of the print media, instead of passing laterally under the pinch rollers. By contrast, short media feed steps have been found to encourage media bubbles to pass laterally under the pinch rollers, allowing the print media 130 to become flattened against the platen 400, as opposed to encouraging media bubbles to continue growing. Therefore, in the preferred embodiment, the sequence of media feeds commences with media feeds of a short distance.

However, when the size of a media bubble is relatively small, it is relatively rigid. In such cases, it has been observed that the media bubble has a tendency to translate laterally under the pinch wheels without collapsing when short media feeds are used. The exact size of a media bubble, for example, that exhibits this behavior depends upon various factors, such as the print media type, the quantity of ink deposited on the print media and the ambient conditions. However, generally it has been found that media bubbles of an approximate width of 5 mm tend to exhibit this behaviour. It has also been found that in such cases, media feeds of greater distances are more effective in allowing the print media to relax in these areas. Therefore, in the preferred embodiment, the sequence of media feeds includes a series of media feeds, corresponding to repeated steps 60 and 70, of an increased distance after the initial short distance media feeds.

It has also been found that the use of high feed speeds during the feed steps facilitate the lateral slippage of the print media 130 between the pinch rollers 310 and the main drive roller 300. Thus, the required flattening of the print media 130 is obtained more rapidly, by using high feed speeds. Thus, in the present embodiment, each of the media feed steps is implemented at the highest media feed speed of the printer 110 of the present embodiment; which is approximately, 5 inches per second.

By using high print media feed speeds, the friction which normally holds the print media 130 in place between the pinch rollers 310 and the main drive roller 300 along the scan axis in partially overcome. This has the effect of allowing the print media 130 to slide more easily relative to the drive roller 300 and the pinch rollers 310 along the scan axis; thus accelerating the process of the embodiment. This process is also augmented by the relatively high accelerations and decelerations which are imparted to the main drive roller 300 when high feed speeds are used.

The skilled reader will appreciate that the preferred feed speeds will depend upon the operational set up in a given situation. Therefore, the optimal feed speeds for different situations may be determined by experimentation using the information disclosed herein.

OTHER EMBODIMENTS

The Applicant has established through practical investigation that the method of the above-described embodiment is particularly beneficial in flattening print media in which cockle or media bubbles have developed. However, various other media feed sequences may also be used to good effect. Thus, the skilled reader will appreciate that various modifications may be made to the above described method in order to achieve the objects of the present invention.

As the skilled reader will appreciate, the optimum sequence of media feeds will depend upon various factors such as the characteristics of the printer used, the characteristics of the print media being used, the quantity of ink which is deposited on the print media and the ambient conditions including temperature and humidity. Thus, the exact sequence of media feeds may be determined experimentally, based upon the information disclosed herein.

Furthermore, as has been stated above, print media which is susceptible to cockle expands in a cumulative manner as it is printed on. Thus, the degree to which a given section of print media will benefit from being flattened will be determined by the degree to which it is cockled. Therefore, the skilled reader will appreciate that in general terms a relationship exists between the frequency that a media flattening routine according to the present invention is implemented and the amount that each media flattening routine is required to flatten the print media. Thus, if a media flattening routine is implemented frequently, it will generally be required to flatten the print media to a lesser extent than if it is implemented infrequently.

Therefore, the skilled reader will appreciate that the number of feed steps in the present invention could be significantly increased or decreased in dependence upon how often in is implemented and how cockled the print media is generally found to become for a given operational set up.

However, in order to avoid paper wastage, it would be desirable that the sum total to which the print media is fed in a positive direction is matched by the sum total to which the print media is fed in a negative direction. In this manner, the next image to be printed may be printed close to the previous image and print media wastage may be minimized. Thus, one example of a media flattening routine according to the present invention may comprise two media feeds only, the first in the positive feed direction and the second in the negative direction. However, in such a case, the distance of the feed may need to be comparatively large, for example 24 or 36 inches, in order to have the desired flattening effect. In extreme cases, this may cause a problem in that the print media may come into contact with the surface on which the printer device is located, thus damaging the print media. Another example may include feeds of distance of less than one inch, for example 0.5 inches. However, in such a case, it may be found that the required number of feeds of this length results in the process taking a longer period of time than is desirable.

Furthermore, the skilled reader will appreciate that instead of implementing the invention to carry out both short and long media feed in one routine, it would be possible to implement separate routines at different times. Thus, one routine may comprise predominantly long print media feeds and anther may comprise predominantly short media feeds.

These routines could be implemented, for example, in an alternating manner, separated by the printing of one or more images.

Furthermore, depending upon operating factors such as the characteristics of characteristics of the printer used, the quantity of ink which is deposited on the print media and the ambient conditions including temperature and humidity, it may be found that only predominantly, only certain types of cockle or print media bubble are encountered; for example small rigid bubbles. In such cases, it is clear that only the appropriate length of media feed, as described herein need be employed in order to flatten that type of cockle or print media bubble. Therefore, in such circumstances, a media feed routine of the present invention may comprise media feed of predominantly, or exclusively one length.

It will also be clear to the skilled reader that the degree to which the print media is susceptible to cockle or media bubbles is determined by various factors, such as the type of media being used, the quantity of ink which is deposited on the print media and the ambient conditions including temperature and humidity. Therefore, the skilled reader will appreciate that the printer control unit may be programmed to implement varying media flattening routines at differing intervals depending upon various usage criteria. This may be achieved by comparing user input data and/or data stored by the printer itself, in a manner known in the art regarding recent printing history and the ambient conditions with a look up table stored in a memory associated printer control unit. Furthermore, the exact type of media flattening routine may be determined in the same manner. Alternatively, the details of the type and frequency of the media flattening routine to be used could be determined and input into the printer by the operator.

Although, it would not generally be desirable to implement a series of media feeds whilst printing an image, since by doing so, a noticable line or join may be generated between the portions of the image that were printed before and after the implementation of the media feed sequence, the skilled reader will appreciate that in certain circumstances such a line or join may either not be noticable, or may not matter. For example, such a line or join may not be noticable in a engineering drawing where a blank, or substantially blank portion extends the whole way across the print media in the direction of the scan axis. Furthermore, such a line or join may not matter if an image is being printed in draft quality. In such situations, the present invention may be satisfactorily implemented during the printing process.

Additionally, although the above embodiments have been described with reference to printing on roll fed print media, the skilled person will appreciate that the invention may be applied with good effect to cut sheets. This will be especially true of cases where more than one images of high ink density are printed consecutively on a single sheet.

What is claimed is:

1. A method of flattening print media in an ink jet apparatus, said apparatus comprising a media feed path, a media drive roller and one or more pinch rollers, said one or more pinch rollers being arranged to rotatably cooperate with said drive roller so as to grip said media therebetween, said drive roller having a rotational axis extending substantially transverse to said feed path and being arranged to rotate in first and second directions to respectively feed said media in first and second feed directions; said method comprising the steps of:

feeding said media a first distance in said first feed direction; and then, feeding said media a second distance in said second feed direction, thereby causing said media to flatten in a direction substantially transverse to said feed path.

2. The method according to claim 1, wherein said first feed direction is the forward feed direction and said second feed direction is the backward feed direction.

3. The method according to claim 2, wherein said second feed distance is less than or equal to said first feed distance.

4. The method according to claim 2, further comprising one or more pairs of media feeds, each said pair of media feeds comprising a media feed in the forward feed direction followed by a further media feed in the backward feed direction.

5. The method according to claim 4, wherein said further media feed in the backward feed direction of a given said pair of media feeds is of substantially the same distance as said media feed in said forward feed direction of said pair.

6. The method according to claim 5, wherein each subsequent said one or more pairs of media feed is of a distance that is substantially the same distance or greater than that of the previous said pair of media feeds.

7. The method according to claim 5, where said first and second feed distances are of approximately 1 inch, the method further comprising two further pairs of media feeds, wherein said feed distance in both the forward and backward feed direction of the first of said further pairs of media feeds is approximately 2 inches and said feed distance in both the forward and backward feed direction of the second of said further pairs of media feeds is approximately 4 inches.

8. The method according to claim 7, further comprising two further pairs of media feeds, wherein said feed distance in both the forward and backward feed direction of both of said two further pairs of media feeds is approximately 4 inches.

9. The method according to claim 1, wherein said first and said second feed distances are between 0.5 inches and 4 inches.

10. The method according to claim 1, wherein said first and said second feed distances are between 4 inches and 36 inches.

11. The method according any one of claims 4 to 8, wherein the number of feed pairs is selected in dependence upon any one of the following: the temperature; the relative humidity; the media type being printed on; the quantity of ink printed in a given area or length of print media; the number of prints that have been carried out since the pinch rollers were last released.

12. The method according to claim 11, wherein the number of feed pairs is selected in dependence upon data accessed from a look up table held in the operating system of the printer apparatus.

13. An ink jet printer arranged to implement the method of claim 12.

14. The method according to claim 11, wherein the number of feed pairs is selected in dependence upon data input by a user.

15. An ink jet printer arranged to implement the method of claim 14.

16. The method according to claim 11, wherein the number of feed pairs is selected in dependence upon data measured by the printer apparatus.

17. An ink jet printer arranged to implement the method of claim 16.

18. An ink jet printer arranged to implement the method of claim 11.

19. A method of printing first and second images on a continuous sheet of print media with an ink jet apparatus, said media having a width and a length and being driven between opposing rollers adapted to engage said media substantially along said media width, said opposing rollers being adapted to drive said media in a forward media advance direction and in a backward media advance direction; the method comprising the following steps arranged to allow said media in which one or more media bubbles have formed, to translate substantially in the direction of said media width to flatten said one or more media bubbles, said following steps being carried out in between the processes of printing said first and second images, without disengaging said opposing rollers;

feeding said print media a first distance in the forward media advance direction; and then, feeding said print media a second distance in the backward media advance direction.

20. An ink jet printer arranged to implement the method of any of claims 1–8 and 19.

* * * * *